US005865425A

United States Patent [19]

Meadows

[11] Patent Number: 5,865,425

[45] Date of Patent: Feb. 2, 1999

[54] MANHOLE COVER EXTRACTOR

[76] Inventor: Harry Douglas Meadows, 5 Gardenia Cir., Abilene, Tex. 79605

[21] Appl. No.: 4,311

[22] Filed: Jan. 8, 1998

[51] Int. Cl.[6] ..... B66F 11/00

[52] U.S. Cl. ..... 254/131; 254/25; 254/26 R; 7/143; 7/146; 7/147

[58] Field of Search ..... 7/143, 146, 147; 30/164.5, 164.8; 125/43; 254/131, 25, 26 R

[56] References Cited

U.S. PATENT DOCUMENTS

| | | | |
|---|---|---|---|
| 097,715 | 12/1869 | Smith | 7/146 |
| 418,541 | 12/1889 | Stewart | 7/146 |
| 459,643 | 9/1891 | Montgomery | 7/146 |
| 4,476,597 | 10/1984 | Gobbi | 30/164.5 |
| 4,978,103 | 12/1990 | Moisen | 254/131 |

*Primary Examiner*—Robert C. Watson

[57] ABSTRACT

A manhole cover extractor for loosening and lifting a cover by using rods in slots in the top of the cover or drain holes in the cover, the extractor having an elongated head with one end shaped as a sledge hammer and the other end shaped as a tapered, curved arm having a rounded bottom with a pointed pry tip. The curvature of the arm is along a tangent to the bottom center of the arm to position the pry tip under a rod or in a drain hole to engage the bottom of the cover. Serration's on the top of the arm to seat a rod in the slot or a drain hole. A hole in the center of the head receives a handle for swinging the sledge hammer to loosen the cover and to act as a lever for the pry tip when the handle is lifted and pulled.

3 Claims, 3 Drawing Sheets

MANHOLE COVER EXTRACTOR

FIELD OF THE INVENTION

This invention relates to a tool to loosen a manhole cover that is stuck to the manhole and to extract the cover from the manhole.

BACKGROUND OF THE INVENTION

A manhole is generally covered with a round, cast metal cover that weighs up to, or more than 200 pounds, and in some cases more than 300 pounds. Because of the weight, lifting the cover by hand to enter the manhole for maintenance is very difficult. If the cover is stuck to the top of the manhole by tar, grime, ice, or such, the cover can not be moved at all until loosened. The cover may have slots in its top with a rod transverse in each slot, or several round drain holes in the top. The rods and drain holes can be used as an aid when removing the cover from the manhole.

Patents have issued for tools that may be used in the slots and drain holes to help a worker to extract the cover. For example, U.S. Pat. No. 3,362,684 discloses a tool which uses a key, extension combination in which the key is inserted into a drain hole and engages the under side of the cover. The extension is connected to adjustment holes in the key and applies a fulcrum to lift one side of the cover. The tool requires additional apparatus attached to the tool for extracting the cover. Such a tool must be very substantial in construction if the fulcrum it produces is to lift such weight or to loosen a stuck cover. The additional parts required to be attached to the tool require additional work time to extract the cover from the manhole. U.S. Pat. No. 3,985,338 discloses a hook that is inserted into a drain hole to contact the under side of the cover. It is connected to a foot lever that is separated from the hook by a fulcrum point. When the foot lever is stepped upon, the lever and created fulcrum will lift a side of the cover. It is suggested that two workers may be required to stand on the lever to effectively use the tool to loosen and lift a cover.

Because of the weight of the cover, such tools must be of a very sturdy construction to be used to lift a cover that weighs several hundred pounds, without considering fact that the tool must also be used to loosen a stuck cover. The cover is most often extracted by sliding the cover away from the manhole after a side is lifted. In most worker applications a hammer, or other tool for pounding, is used to loosen the cover before any attempt is made to lift the cover. A crowbar, or any other handy pry bar, is then used to lift and slide the cover away from the manhole. The use of several different tools, or a tool with multiple parts, to extract the cover can result in wasted time because the tools are inappropriate for the job, or it takes repeated trips back and forth to a maintenance truck from the manhole to retrieve a different tool or parts of a tool. Also, there is the possibly of endangering a worker caught in traffic going back and forth, as many manholes are located in streets with heavy traffic.

An appropriate tool for such a job is an all-in-one tool that is easy to carry and can be used to loosen a cover that is stuck to the manhole top and be used to lift a side of the cover. Then, while maintaining contact with the cover, it is to be used to slide the cover away from the manhole.

Therefore an object of my invention is to provide an all-in-one tool that can be used to loosen the cover when it is stuck to the manhole and be used to lift a side of the cover from the manhole, then be used to slide the cover from the manhole while continuously maintaining contact with the cover.

A feature of my invention is it that it is an easy to carry, one-piece tool used to loosen a cover that is stuck to the manhole and then to extract the cover from the manhole.

Another feature of the invention is that when it is used it engages the rod or drain hole inner wall so that it will not slip when used to lift an edge of the cover and then slide it free from the manhole.

Another feature is that the tool is cast of heavy steel of size that when used to strike the cover, the size and weight produce force to easily loosen a cover that is stuck to the manhole.

SUMMARY OF THE INVENTION

I have invented a one-piece tool for loosening, lifting and sliding a manhole cover that may be stuck to the top of the manhole. The tool, made of heavy constructed steel, is first used to loosen the cover, then to be used with the rods or drain holes in the cover to lift one side of the cover from the manhole and while maintaining contact with the rod or drain hole to be used to slide the cover away from the manhole. The tool comprises a head formed as a sledge hammer at one end, and an arm lateral thereto and part of the head. The arm is curved (convex) and tapered with a rounded bottom that ends in a pointed pry tip. A handle is received into an opening in the sledge hammer. The handle is used to swing the sledge hammer, and to act as a lever for the pry tip. The pry tip, rounded bottom and curvature of the arm are important to my invention. A tapered, rounded bottom of the arm, when used in conjunction with the pointed pry tip, makes it easy to slide the arm into most cover slots to place the pry tip under a rod in a position to provide for maximum pry power to be applied. A tapered arm with a rounded bottom and pointed pry tip will also fit the pry tip into most drain holes where the curvature of the arm positions the pry tip to engage the under side of the drain hole and cover to give it maximum contact with the surface, which also produces maximum pry power when applied. To produce the proper curvature of the arm, the curvature is calculated to be formed along a tangent to the bottom center of the arm such that the tangent intersects a right triangle having one side parallel to a vertical axis of the tool at an angle of approximately 45 degrees. I serrate the top side of the arm to strengthen the arm and to provide a serration to engage a rod or the inside of a drain hole to reduce any tendency of the tool to slip in the slot or hole when the tool is used. When the arm is inserted into the slot or the pry tip enters a drain hole, a serration engages a rod or the inside edge of a drain hole to seat the tool. The handle is lifted upward and pulled so that the pry tip applies pressure to the rod or the underside of the cover to lift the cover up at one side and at the same time slide the cover away from the manhole.

DETAILED DESCRIPTION OF THE DRAWINGS

Figure 3:
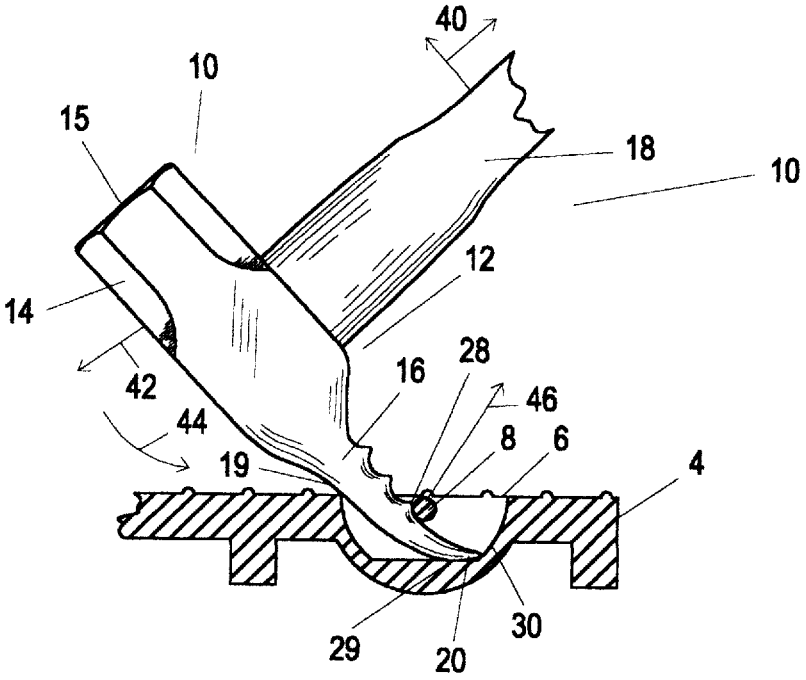
FIG. 3 is a sectioned, side elevation view of the tool with the pry tip in a cover slot.
Figure 4:
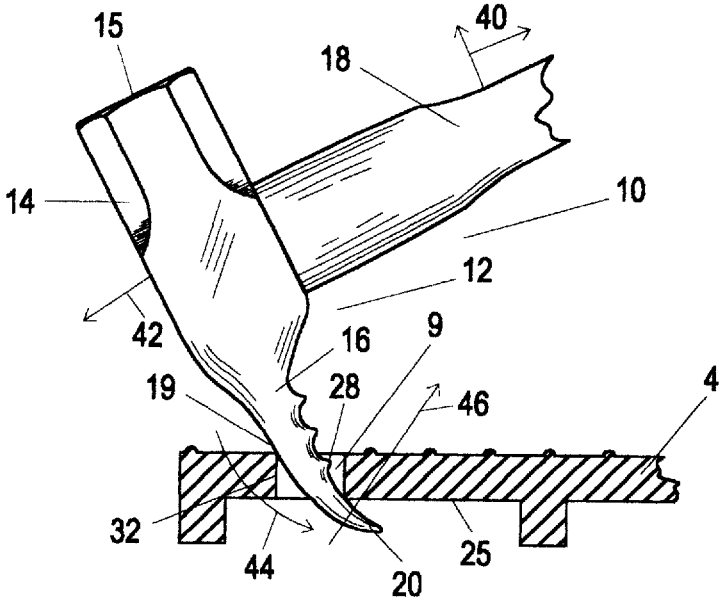
FIG. 4 is a sectioned, side elevation view of the tool with the pry tip in a drain hole.
Figure 5:
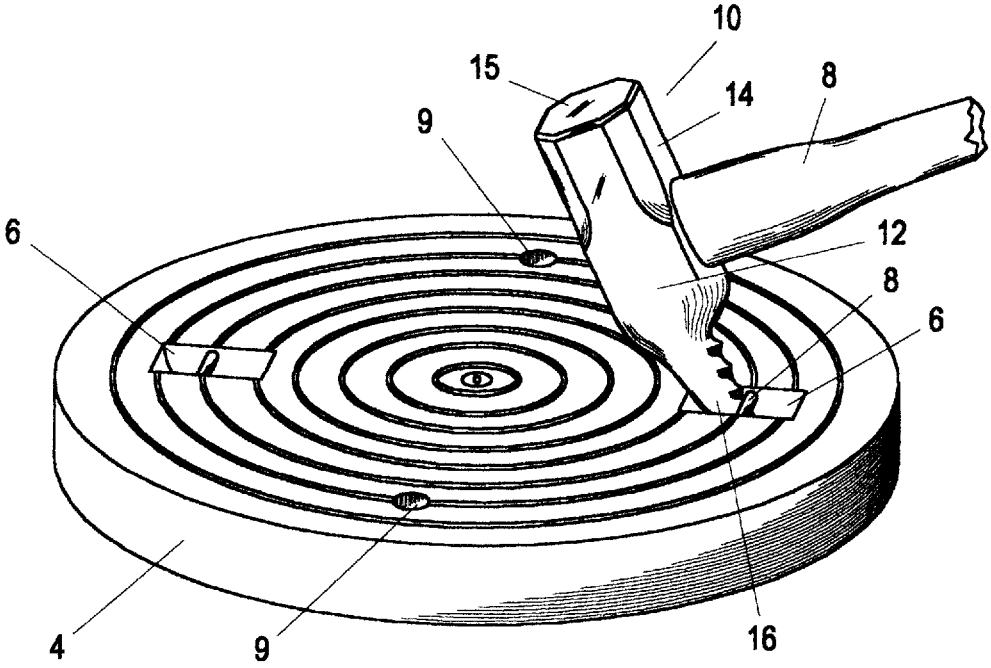
FIG. 5 is a perspective view of the tool and cover as the tool is used.

My invention is a tool 10 of single-head construction, shown in FIGS. 1 through 5, that is used to loosen, to lift a side of a manhole cover 4, and to slide the cover away from the manhole. The cover 4, most clearly seen in FIG. 5, is a conventional, round cover with two slots 6 in its top. Each slot 6 is located near the periphery of the cover 4 with a rod 8 transverse in its center that may be used by a worker to extract the cover 4. Some covers have only drain holes 9 located in the top. Drain holes 9, although shown in FIG. 5 in the same cover 4 with the slots 6, would not usually be found in the same cover.

Figure 1:
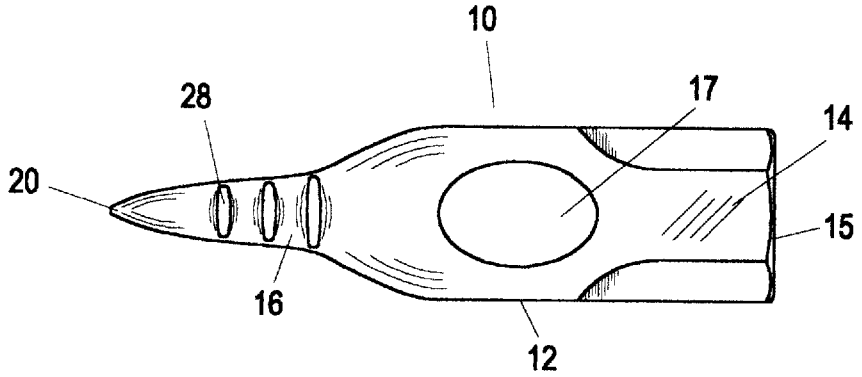
FIG. 1 is a plan view of the tool.
Figure 2:
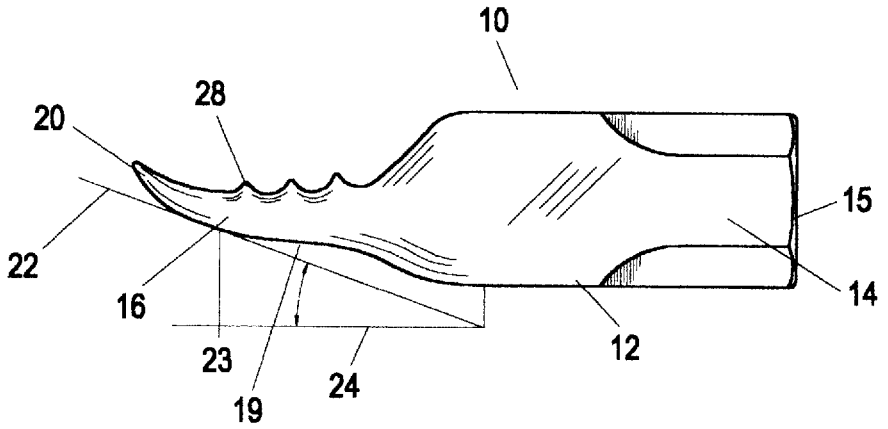
FIG. 2 is a side elevation view of the tool.

FIGS. 1 and 2 show that the tool 10 is a one-piece head 12, which is made of cast steel (I recommend 12 lb. 4110 steel), formed as an octagonal sledge hammer 14, with a tapered, curved arm 16, rounded at the bottom that extends laterally from the sledge hammer 14. The sledge hammer 14 is flat on the end 15, and may be beveled. It is purposely cast of material and size to produce a large force to loosen the cover 4 when it is struck. Centered approximately between the sledge hammer 14 and arm 16 in the sledge hammer 14 is an opening 17 that receives a handle 18 that is attached to the head 12 by conventional means.

The arm 16 is rounded on its bottom 19 from the approximate center of the sledge hammer 14 to a pry tip 20, at the end of the arm 16. The curvature of the arm 16 is along a tangent 22 at contact point 23 approximately midway of the bottom 19 of the arm 16. The tangent 22 intersects a right triangle 24 to form an angle of approximately 45 degrees, one side of which is parallel to a vertical axis through the center of the opening 17. The location of the tangent point 23 is calculated to give the arm 16 a curvature that will position the pry tip 20 under the rod 8 or into the drain hole 9 a distance that produces contact with the rod 8 or an under side 25 of the cover 4 for its maximum amount of use as a pry tip 20.

I serrate the arm 16 on its top 28 to give the arm 16 extra strength to withstand stress and to promote contact of the pry tip 20 with a rod 8 or in a drain hole 9. Also I shape the arm 16 to slope from the lateral end of the sledge hammer 14 at 29 to the first serration 28 to give the arm 16 additional strength to withstand stress. A rod 8 will engage a serration 28 when the tool 10 is positioned as shown in FIGS. 3 and 5. The contact of the pry tip 20 with the underside 30 of the slot 6 coupled with the contact of the serration 28 with the side of the rod 8 produces a fit of the rod 8 that substantially reduces any tendency of the tool to slip when being used to lift the cover 4.

As shown in FIG. 4, a serration 28 will also engage an inside 30 of a drain hole 9 when the pry tip 20 is inserted into the drain hole 9. The rounded bottom 19 of the arm 16 will engage an opposite inside 32 of the drain hole 9. These contacts produce a seat of the pry tip 20 within the drain hole 9 and against the under side 25 to reduce any tendency of the pry tip 20 to slip when the tool 10 is used to lift the cover 4. Drain holes vary in size depending upon the manufacturer of the cover. A larger size drain hole 9 would increase the contact of the pry tip 20 with the underside 25.

Further, a rounded bottom 19 is important in that the arm 16 and pry tip 20 will more easily slide into the variety of manhole cover slots 6 that exist, pushing passed any rocks, dirt or other debris that are usually found the slots 6. The tool 10 will dislodge the debris, therefore cleaning out such debris is not necessary before using my invention.

In use, the tool 10 is positioned with respect to the rod 8, as shown in FIG. 3, where the arm 16 is inserted into the slot 6 as far as it will go. A serration 28 and pry tip 20 engage the rod 8. The handle 18 is lifted and pulled at the same time. Arrows 40 show the approximate direction of travel of the handle, and arrows 42,44 show the approximate direction of travel of the sledge hammer 14 and the arm 16. These directions of travel produce the necessary force on the rod 8 in the direction of arrow 46 to lift the cover from the top of the manhole so that it can be slid away. In many cases the handle is "yanked" upward and pulled at the same time. The results would be as previously described.

In FIG. 4 the pry tip 20 is shown in a drain hole 9 where the arm 16 engages the inner side 31 and the bottom 19 engages the opposite side 32, with the pry tip 20 positioned to engage the underside 25 of the cover 4, adjacent to the drain hole 9. When the handle 18 is lifted and pulled at the same time, the lever acts on the arm 16 and pry tip 20. The power produced lifts and pulls one side of the cover 4 away from the manhole. When the handle is "yanked" in this application the motion of the handle 18 and head 12 is as previously described.

One reason that it is important that the tool 10 be in contact with the cover 4 is that the tool 10 is designed to be a tool used by one person, Thus, once the cover 4 is lifted it should be slid free of the manhole all in one motion. The tool could be inverted and used to lift the cover straight up for removal. However, the weight of the cover may be too great for such application.

FIG. 5 is presented for an overall view of the position of the tool 10 for lifting the handle 18 to raise the cover.

I claim:

1. A tool for loosening and extracting a manhole cover that includes rods transverse in slots in the cover, or drain holes in the cover, each useful as an aid to remove the cover from the manhole, comprising;

a one-piece, elongated head having one end shaped as a sledge hammer usable to loosen a stuck cover, and the other end lateral thereto having a tapered, curved arm, the curvature of the arm being along a tangent to the bottom of the arm making an approximately 45 degree angle with a right triangle, one side of which parallels a line along a vertical axis of the tool, and a rounded bottom, said arm ending in a pointed pry tip to be inserted under a rod or into a drain hole in the cover;

serration's on the top of the arm to engage a rod or the inside of the drain hole when inserted to secure the pry tip with the rod or in the drain hole;

an opening in the sledge hammer extending through the head, and a handle received in the opening and secured therein with which to swing the hammer and when lifted to act as a lever for the pry tip.

2. A tool for loosening a manhole cover that is stuck to the top of the manhole and for lifting an sliding a side of the cover from the manhole, the cover having slots in its top with a transverse rod in each slot or a plurality of drain holes, comprising:

a one-piece, cast steel head formed at one end in a sledge hammer shape;

a tapered, curved arm having a rounded bottom, said arm extending laterally from the sledge hammer and terminating in a pointed pry tip, said arm to be inserted into a slot or drain hole where said pry tip engages and slides under a rod or into a drain hole wherein said pry tip engages the under side of the cover;

serration's along the top of the arm one of which engages a rod or the inside of the drain hole when the pry tip is inserted under a rod or into a drain hole;

an opening in the top of the sledge hammer;

a handle received within said opening and extending vertically from said head, said handle to be used to swing the sledge hammer and to act as a lever for the pry tip when the pry tip engages a rod or is inserted into a drain hole and the handle is lifted and pulled to lift and slide the cover.

3. A tool for loosening a manhole cover that is stuck to the manhole and to lift and slide the cover away from the manhole, the cover having rods transverse in slots in the cover, comprising:

a one piece, steel head formed at one end in a sledge hammer shape;

a tapered, curved arm having a rounded bottom, said arm extending laterally from the sledge hammer and terminating in a pointed pry tip, said arm to be inserted into a slot of the cover to engage the pry tip under a rod;

serration's along the top of said arm, where one serration engages a rod and seats said pry tip under the rod when said arm is inserted into a slot;

an opening in the top of the head and, a handle received within the opening, extending vertically from said head for swinging the sledge hammer to loosen the cover and to act as a lever for said pry tip when the handle is lifted and pulled to lift and slide the cover.

* * * * *